US005547795A

United States Patent [19]

Ochiai et al.

[11] Patent Number: 5,547,795

[45] Date of Patent: Aug. 20, 1996

[54] MAGNETIC CARRIER FOR DEVELOPER

[75] Inventors: Masahisa Ochiai, Fukaya; Tsutomu Saitoh; Masumi Asanae, both of Kumagaya, all of Japan

[73] Assignee: Hitachi Metals, Ltd., Tokyo, Japan

[21] Appl. No.: 492,866

[22] Filed: Jun. 20, 1995

[30] Foreign Application Priority Data

Jun. 22, 1994 [JP] Japan ..... 6-139947

[51] Int. Cl.[6] ..... G03G 9/107

[52] U.S. Cl. ..... 430/106.6; 430/108; 430/111

[58] Field of Search ..... 430/106.6, 108, 430/111

[56] References Cited

U.S. PATENT DOCUMENTS 2,965,573 12/1960 Gundlach ..... 430/111 X 4,996,126 2/1991 Anno et al. ..... 430/108 X 5,093,201 3/1992 Ohtani et al. ..... 430/108 X

FOREIGN PATENT DOCUMENTS 5-76628 10/1993 Japan .

*Primary Examiner*—Roland Martin

*Attorney, Agent, or Firm*—Morgan, Lewis and Bockius LLP

[57] ABSTRACT

A magnetic carrier for a developer for use in electrophotographic recording, comprising a ferromagnetic particle of an average particle size of 100 μm or less, a ratio (T/a) of the minimum outer size (T) and the maximum outer size (a) of the magnetic carrier being 0.02–0.5. Since the magnetic carrier has a large specific surface area, a toner can be sufficiently charged by the magnetic toner. Therefore, a high quality printed image free from defect such as fogging, spreadness, carrier adhesion, streak, etc. can be obtained even in continuous printing of a long period of time.

10 Claims, 1 Drawing Sheet

MAGNETIC CARRIER FOR DEVELOPER

BACKGROUND OF THE INVENTION

The present invention relates to a magnetic carrier for a developer, which is used as a constituent of a developer for developing electrostatic latent images in electrophotographic recording apparatus such as printers, facsimiles, copying machines, etc.

In conventional electrophotographic recording apparatus, it is known that a visual toner image is produced by the successive steps of (1) forming an electrostatic latent image corresponding to original image or information data, for instance, on a photosensitive surface of a cylindrical image-bearing member, (2) magnetically attracting a magnetic developer comprising a magnetic carrier and a magnetic or non-magnetic toner on a rotatable developing roll equipped with an inner permanent magnet and disposed opposing the image-bearing member, (3) delivering the magnetic developer, while forming a magnetic brush, to a developing zone where the electrostatic latent image on the image-bearing member is slidingly brushed with the magnetic brush. The developed image is then transferred to a recording sheet and fixed thereon by heating.

In the conventional magnetic developer, a magnetic carrier of spherical or non-spherial granular shape is usually used in view of improving flowability of the developer. However, a small specific surface area of the known spherical or non-spherial granular magnetic carrier inevitably leads to a small contact area of the carrier and the toner. Therefore, the toner cannot be sufficiently charged by the carrier to obtain a small amount of triboelectric charge, thereby failing to obtain a clear toner image because an insufficient amount of triboelectric charge of the toner usually causes printing defect such as fogging, etc.

Further, proposals have been made to form a fine toner image by reducing a size of the magnetic carrier. By using the magnetic carrier having a reduced size, a toner image with a high resolution and a high quality can be obtained due to the formation of a thin developer layer on a sleeve of a developing means. However, since the magnetic carrier with a reduced size fails to be well magnetically retained on the developing means, the magnetic carrier is likely to scatter, thereby causing problems such as the contamination of the developing means and nearby elements, deterioration in a quality of the toner image, etc.

A magnetic carrier of flat shape having a large particle size exceeding 100 μm has been also proposed. However, such a magnetic carrier has problems of damaging a photosensitive surface or causing streaks in printed images because of vigorous moving of the magnetic carrier accompanied by the rotation of a developing roll.

OBJECT AND SUMMARY OF THE INVENTION

Accordingly, an object of the present invention is to provide a magnetic carrier for a developer for use in an electrophotographic recording apparatus, which is free from the above conventional problems and capable of providing a toner with a sufficient amount of triboelectric charge, effectively preventing fogging of printed images, and providing a printed image with high quality.

As a result of intense investigation, the inventors have found that a magnetic carrier having a specific average particle size and a specific value of the ratio (T/a) of the minimum outer size (T) and the maximum outer size (a) of a magnetic carrier can achieve the above object. The inventors have further found that a more beneficial effect can be obtained by coating the above magnetic carrier with a resin layer. The present invention has been completed based on this finding.

Thus, the present invention provides a magnetic carrier for a developer comprising a ferromagnetic particle of an average particle size of 100 μm or less, a ratio (T/a) of the minimum outer size (T) and the maximum outer size (a)of the magnetic carrier being 0.02–0.5.

Further, the present invention provides a magnetic carrier comprising the ferromagnetic particle as defined above which is coated with a resin layer.

DETAILED DESCRIPTION OF THE INVENTION

The present invention will be described in detail below.

As the ferromagnetic material for the magnetic carrier, ferrites (Ni-Zn ferrite, Mn-Zn ferrite, Cu-Zn ferrite, etc.), magnetites, iron powder including pulverized iron powder and reduced iron powder, etc. may be exemplified.

The magnetic carrier of the present invention is made of the above ferromagnetic material and has an average particle size of 100 μm or less, more preferably 50 μm or less. When the average particle size is too small, so-called scattering of the carrier takes place, leading to poor quality of a toner image due to adhesion of the scattered carrier to a developing means, an image-bearing member, and nearby elements, etc. To prevent the scattering, the lower limit of the average particle size is preferred to be 10 μm. A particularly preferable range of the average particle size is 20–50 μm.

The suitable shape of the magnetic carrier of the present invention is non-spherical shape such as a polyhedral shape, a flaky shape, a flat shape, a scalelike shape, irregular shapes, non-spherial granular shape, etc., and is specified by the ratio (T/a) of the minimum outer size (T) and the maximum outer size (a) in the range of 0.02–0.5, preferably 0.03–0.5, and more preferably 0.05–0.5. The non-spherical shape having the ratio (T/a) in the above range contributes to increasing the specific surface area of the magnetic carrier and enhances the ability of the magnetic carrier to triboelectrically charge the toner. When the ratio (T/a) exceeds 0.5, the magnetic carrier is approximately spherical to reduce the ability of the magnetic carrier to triboelectrically charge the toner. A magnetic carrier of the ratio (T/a) smaller than 0.02 shows a poor flowability to prevent a uniform delivery of a developer by a sleeve, resulting in uneven printed images.

Figure 1:
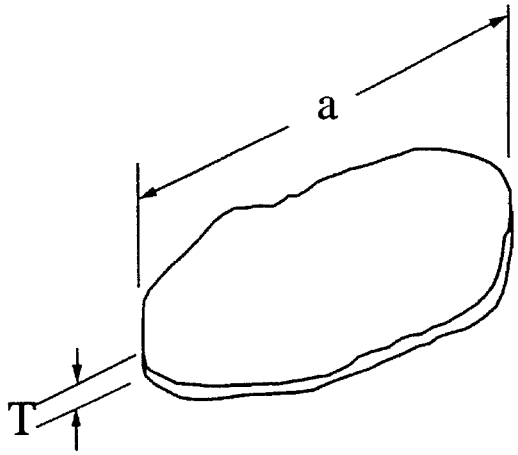
FIG. 1 is a schematic view showing the minimum outer size (T) and the maximum outer size (a) of a magnetic carrier of flat shape having a ratio T/a of 0.02.
Figure 2:
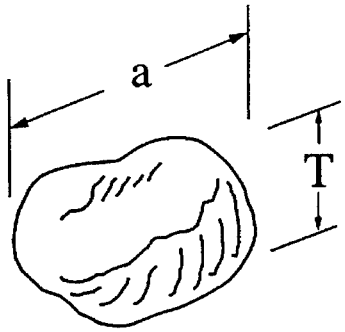
FIG. 2 is a schematic view showing the minimum outer size (T) and the maximum outer size (a) of a magnetic carrier of non-spherial granular shape having a ratio T/a of 0.5.
Figure 3:
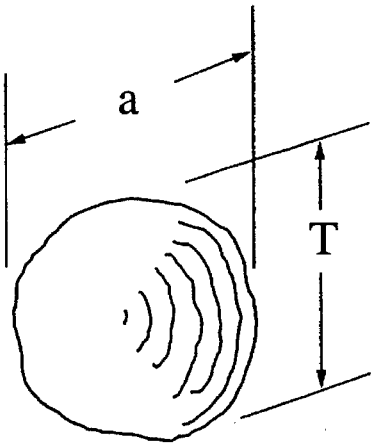
FIG. 3 PRIOR ART
FIG. 3 is a schematic view showing the minimum outer size (T) and the maximum outer size (a) of a magnetic carrier of spherical shape a ratio T/a of 1.

FIGS. 1–3 are schematic view showing the minimum outer size (T) and the maximum outer size (a) of a flat magnetic carrier (FIG. 1), a non-spherial granular magnetic carrier (FIG. 2) and a spherical magnetic carrier (FIG. 3). The conventional magnetic carrier of spherical shape (FIG.

3) of the ratio (T/a) of 1 has a small specific surface area. On the other hand, the magnetic carriers (FIGS. 1 and 2) of the present invention are of non-spherical shape of the ratio (T/a) of 0.02–0.5 and have specific surface areas larger than that of the conventional magnetic carrier of FIG. 3.

The magnetic carrier of the present invention may be produced, for example, by the following method. First, a ferrite particle or iron particle of spherical, near spherical or irregular shape is produced. To produce the ferrite particle, a mixture of oxides is calcined, pulverized and made into a slurry in a ball mill with an appropriate solvent, usually water, optionally containing a binder. The slurry is then subjected to granulation and drying by a spray drier followed by sintering and disintegration to obtain the ferrite particle of spherical shape. In case of the iron particle, a scrap of mild steel are subjected to successive treatments including a primary pulverization, an oil quenching, a mineral dressing and an nitriding to prepare a primary iron particle. The primary iron particle is then pulverized and is subjected to successive treatments of denitrogenation and oxidation to obtain iron particle of irregular shape. A spherical iron particle is obtained by subjecting a pulverized iron material to heating with oxidizing flame and subsequent reduction. The particle of spherical, near spherical or irregular shape is then mechanically treated, for example, crashed or hammer-milled. Alternatively, the above particle is supplied between a pair of rolls rotating in opposite directions with a predetermined nip to obtain a flat particle. The particle thus treated is finally classified into a desired particle size to obtain the magnetic carrier of the present invention.

The magnetic carrier of the present invention may be coated on its surface with resin layer to inhibit corrosion with rust or to regulate the specific volume resistance of the magnetic carrier. Suitable materials for the resin layers may include homopolymers or copolymers of styrene compounds such as para-chlorostyrene, methylstyrene, etc.; vinyl halides such as vinyl chloride, vinyl bromide, vinyl fluoride, etc.; vinyl esters such as vinyl acetate, vinyl propionate, vinyl benzoate, etc.; acrylic compounds such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, butyl methacrylate, acrylonitrile, methacrylonitrile, acrylamide, etc.; vinyl ethers such as vinyl methyl ether, vinyl isobutyl ether, vinyl ethyl ether, etc.; vinyl ketones such as vinyl ethyl ketone, vinyl hexyl ketone, methyl isopropenyl ketone, etc. Other resins such as epoxy resins, silicone resins, rosin-modified phenol-formaldehyde resins, cellulose resins, polyether resins, polyvinyl butyral resins, polyester resins, styrene-butadiene resins, polyurethane resins, polycarbonate resins, fluorohydrocarbon resins such as polytetrafluoroethylene, etc. may be also usable. These resin materials may be used alone or in combination. Among them, styrene-acrylic resins, silicone resins, epoxy resins, styrene-butadiene resins, cellulose resins, etc. are particularly preferable.

The magnetic carrier may be coated with resins according to the following method. First, the resin material for the resin layer is dissolved in an adequate solvent such as benzene, toluene, xylene, methyl ethyl ketone, tetrahydrofuran, chloroform, hexane, etc., to produce a resin solution or emulsion. The resin solution or emulsion is sprayed onto the magnetic carrier to form a uniform resin layer on the surface of the magnetic carrier. To obtain the uniform resin layer, the magnetic carrier are preferably maintained in a fluidized state desirably by employing a spray dryer or a fluidized bed. The resin solution is sprayed at about 200° C. or lower, preferably at about 100°–150° C., to simultaneously carry out the rapid removing of a solvent from the resultant resin layer and the drying of the resin layer. The resin emulsion is sprayed at a temperature from room temperature to 100° C. to adhere the fused resin on the surface of the magnetic carrier.

The thickness of the resin layer is preferably 0.05–20 μm, and more preferably 0.1–10 μm.

The specific volume resistance of the magnetic carrier is $10^3$–$10^{14}$ Ω·cm, preferably $10^6$–$10^9$ Ω·cm. When the specific volume resistance is smaller than $10^3$ Ω·cm, the magnetic carrier is likely to adhere the electrostatic latent image on the photosensitive surface. On the other hand, a specific volume resistance larger than $10^{14}$ Ω·cm reduces the developing performance because of insufficient bias voltage on the magnetic carrier. The specific volume resistance may be regulated by coating the magnetic carrier with the resin mentioned above containing an electroconductive particle such as carbon black, metal powders, etc. On the coating thus formed, the electroconductive particle may be further coated. Alternatively, a method where the electroconductive particle is coated on the resin layer formed in advance on the magnetic carrier as mentioned above is also usable. These methods are particularly effective in regulating the specific volume resistance to $10^6$ Ω·cm or less.

In the present invention, the specific volume resistance of the magnetic carrier was determined from electric resistance measured on appropriate amounts (several tens of mg) of the magnetic carrier charged into insulated dial-gauge type cylinders made of Teflon (trade name) and having an inner diameter of 3.05 mm (cross-sectional area: 0.073 $cm^2$) and exposed to an electric field of D.C. 200 V/cm under a load of 0.1 kgf, by using an insulation resistance tester (4329A type tester manufactured by Yokogawa-Hewlett-Packard, Ltd.).

In order to prevent the magnetic carrier from scattering and to ensure the magnetic carrier to be magnetically attracted and retained on the developing roll, the magnetization ($\sigma_{1000}$) of the magnetic carrier measured in a magnetic field of 1000 Oe is preferably 40 emu/g or more. The magnetization was measured by a vibrating magnetometer (VSM-III manufactured by Toei Industry Co.,Ltd.)

By using the magnetic carrier mentioned above, the ability to triboelectrically charge the toner can be improved due to increased contact area between the magnetic carrier and the magnetic toner, and high quality images free from spreadness and fogging can be obtained. In particular, the magnetic carrier of the present invention is remarkably effective in electrophotographic printing utilizing a two-component developer (magnetic carrier/magnetic toner) having a high toner concentration, for example 10–90 weight %, while also usable as the component of a two-component developer (magnetic carrier/nonmagnetic toner) having a toner concentration of 2–10 weight %.

The present invention will be described in more detail by way of Examples without intention of restricting the scope of the present invention which is defined by the claims attached hereto.

EXAMPLES 1–3 AND COMPARATIVE EXAMPLES 1–3

The following starting materials:

| | |
|---|---|
| Styrene-acrylic copolymer (7022A manufactured by Good Year Co. Ltd.): | 54 parts by weight, |
| Magnetite (EPT500 manufactured by Toda Kogyo Corp.): | 40 parts by weight, |
| Polypropylene (TP-32 manufactured by Sanyo Chemical Industries Co., Ltd.): | 4 parts by weight, and |
| Charge-controlling agent (Bontron S-34 manufactured by Orient Chemical Industries, Ltd.): | 2 parts by weight, |

were mixed in a kneader equipped with a heating roller for 30 minutes. After cooling and solidifying, the mixture was pulverized, classified and externally added with 0.5 parts by weight of silica (R972 manufactured by Nippon Aerogil Co. Ltd.) to obtain a chargeable magnetic toner having an average particle size of 9.5 μm.

Each of the magnetic carriers listed below was mixed with the magnetic toner prepared above to produce six types of magnetic developers each having a toner concentration of 50 weight %.

| Carrier | Shape | Specific Volume Resistance (Ω · cm) | Particle Size Distribution (μm) | Others |
|---|---|---|---|---|
| A Iron Powder | Flat | $5 \times 10^7$ | 10–44 | — |
| B Iron Powder | Flat | $5 \times 10^7$ | 37–74 | — |
| C Ferrite | Flat | $5 \times 10^8$ | 44–105 | Cu—Zn—$Fe_3O_4$ |
| D Magnetite | Flat | $8 \times 10^{10}$ | 37–74 | Silicone Resin Coating |
| E Iron Powder | Non-spherical granular | $5 \times 10^9$ | 63–125 | Acrylic Resin Coating |
| F Ferrite | Spherical | $2 \times 10^7$ | 37–74 | Cu—Zn—$Fe_3O_4$ |

Each of the developers thus prepared was subjected to printing test by using a reverse printer of rotating-sleeve type under the following conditions. The surface of the OPCdrum was uniformly charged at −700 V and the ratio of the peripheral speed of the OPCdrum and the sleeve (outer diameter: 20 mm, peripheral speed: 100 mm/sec) was regulated to 3.0. Bias voltage of −550 V was applied to the sleeve in which an asymmetric 4-pole ferrite magnet roll (YBM-3 manufactured by Hitachi Metals, Ltd.) was stationarily disposed. The magnetic flux density on the sleeve by the developing pole was 750 G. The doctor gap and the developing gap were adjusted to 0.25 mm and 0.4 mm, respectively.

The results are shown in Table 1. The ratio, T/a, in Table 1 was the averaged value calculated from the measured values on 500 carrier particles on a magnet and a glass plate. The measurement was carried out by using a microscopic image processing apparatus (LUZEX II manufactured b y NIRECO Co. Ltd.). The amount of the triboelectric charge of the developer was measured by a magnet blow-off method at the toner concentration of 50 weight %

TABLE 1

| No. | Magnetic Carrier | T/a | Average Particle Size (μm) | Magnetization Triboelectric ($\sigma_{1000}$) (emu/g) | Charge (μc/g) |
|---|---|---|---|---|---|
| | | | Examples | | |
| 1 | A | 0.03 | 30 | 75 | −10.1 |
| 2 | C | 0.1 | 75 | 42 | −7.2 |
| 3 | D | 0.5 | 47 | 55 | −5.8 |
| | | | Comparative Examples | | |
| 1 | B | 0.01 | 50 | 75 | −12.5 |
| 2 | E | 0.8 | 85 | 89 | −4.7 |
| 3 | F | 1.0 | 47 | 48 | −3.5 |

| No. | Initial Stage of Printing: Image Density | Fogging Density | Spreadness | Carrier Adhesion | After 10000 Printings: Image Density | Fogging Density | Streak |
|---|---|---|---|---|---|---|---|
| | | | Examples | | | | |
| 1 | 1.39 | 0.08 | – | – | 1.37 | 0.09 | – |
| 2 | 1.37 | 0.07 | – | – | 1.35 | 0.07 | – |
| 3 | 1.41 | 0.08 | – | – | 1.40 | 0.08 | – |
| | | | Comparative Examples | | | | |
| 1 | 1.05 | 0.12 | – | – | 0.75 | 0.10 | + |
| 2 | 1.38 | 0.15 | + | – | 1.31 | 0.22 | + |
| 3 | 1.40 | 0.09 | – | + | 1.25 | 0.12 | – |

Note: "–" means not observed, and "+" means observed.

As seen from Table 1, since the magnetic carriers of Comparative Example 2 and 3 are non-spherical granular particle or spherical particle having a T/a ratio larger than the 0.02–0.5 range, the triboelectric charge of the developer was insufficient due to small contact area of the magnetic carrier and the toner. Therefore, the printed image obtained form the developer containing such magnetic carrier showed a high fogging density and suffered from spreadness or carrier adhesion even in the initial stage of printing. After 10000 printings, the image density was reduced whereas the fogging density was increased in both Comparative Examples 2 and 3. In Comparative Example 2, streaks were also observed in the printed images.

In Comparative Example 1, insufficient delivery of the developer due to the small T/a ratio of the magnetic carrier resulted in a low image density, uneven developing and occurrence of streaks in the printed images.

On the other hand, in Examples 1–3, a high quality printed images free from spreadness, carrier adhesion and streak were obtained in the initial stage of printing and even after 10000 printings.

Although the toner concentration of the developer in Examples 1–3 was 50 weight %,the concentration is not restricted to such value. The toner concentration of a developer containing the magnetic carrier of the present invention is 10–90 weight %,preferably 10–40 weight % for a two-component developer of magnetic carrier and magnetic toner, and 2–10 weight %, preferably 2–9 weight % for a two-component developer of magnetic carrier and non-magnetic toner. As the magnetic or non-magnetic toner, those known in the art may be used.

What is claimed is:

1. A two-component developer for use in electrophotographic recording consisting essentially of a magnetic toner having a concentration in the developer of 10–90 percent by weight and a flat magnetic carrier made of a ferromagnetic particle with an average particle size of 100 μm or less, the flat magnetic carrier having a ratio (T/a) of a minimum outer size (T) to a maximum outer size (a) of 0.02–0.5, a specific volume resistance of $10^3$ to $10^{14}$ Ω·cm, and a magnetization ($\sigma_{1000}$) of 40 emu/g or more.

2. The two-component developer according to claim 1, wherein the flat magnetic carrier is coated with a resin layer.

3. The two-component developer according to claim 2, wherein the resin layer is made of a material selected from the group consisting of styrene-acrylic resins, silicone resins, epoxy resins, styrene-butadiene resins and cellulose resins.

4. The two-component developer according to claim 2, wherein the thickness of the resin layer is 0.05–20 μm.

5. The two-component developer according to claim 1, wherein the minimum outer size (T) and the maximum outer size (a) are measured by a microscopic image processing method.

6. A two-component developer for use in electrophotographic recording comprising a magnetic toner having a concentration in the developer of 10–90 percent by weight and a flat magnetic carrier made of a ferromagnetic particle with an average particle size of 100 μm or less, the flat magnetic carrier having a ratio (T/a) of a minimum outer size (T) to a maximum outer size (a) of 0.02–0.5, a specific volume resistance of $10^3$ to $10^{14}$ Ψ·cm, and a magnetization ($\sigma_{1000}$) of 40 emu/g or more.

7. The two-component developer according to claim 6, wherein the flat magnetic carrier is coated with a resin layer.

8. The two-component developer according to claim 7, wherein the resin layer is made of a material selected from the group consisting of styrene-acrylic resins, silicone resins, epoxy resins, styrene-butadiene resins and cellulose resins.

9. The two-component developer according to claim 7, wherein the thickness of the resin layer is 0.05–20 μm.

10. The two-component developer according to claim 6, wherein the minimum outer size (T) and the maximum outer size (a) are measured by a microscopic image processing method.

* * * * *

UNITED STATES PATENT AND TRADEMARK OFFICE

CERTIFICATE OF CORRECTION

PATENT NO. : 5,547,795
DATED : August 20, 1996
INVENTOR(S) : Masahisa OCHIAI et al.

It is certified that error appears in the above-indentified patent and that said Letters Patent is hereby corrected as shown below:

Claim 6, column 8, line 5, change "Ψ·cm" to --Ω·cm--.

Signed and Sealed this

Second Day of September, 1997

*Attest:*

*Attesting Officer*

BRUCE LEHMAN

*Commissioner of Patents and Trademarks*